US007123235B2

(12) United States Patent
Tseng et al.

(10) Patent No.: US 7,123,235 B2
(45) Date of Patent: Oct. 17, 2006

(54) METHOD AND DEVICE FOR GENERATING SAMPLING SIGNAL

(75) Inventors: Jung-Chuh Tseng, Pingtung (TW); Wei Wang, Hualien (TW)

(73) Assignee: Toppoly Optoelectronics Corp., Chu-Nan (TW)

( * ) Notice: Subject to any disclaimer, the term of this patent is extended or adjusted under 35 U.S.C. 154(b) by 621 days.

(21) Appl. No.: 10/600,941

(22) Filed: Jun. 20, 2003

(65) Prior Publication Data

US 2004/0046728 A1 Mar. 11, 2004

(30) Foreign Application Priority Data

Sep. 5, 2002 (TW) ..... 91120315 A

(51) Int. Cl.
*G09G 3/36* (2006.01)

(52) U.S. Cl. ..... 345/98; 345/94; 345/100

(58) Field of Classification Search ..... 345/87, 345/88, 89, 90, 91, 92, 93, 94, 95, 96, 97, 345/98, 100

See application file for complete search history.

(56) References Cited

U.S. PATENT DOCUMENTS 5,818,412 A * 10/1998 Maekawa ..... 345/100
6,492,972 B1 * 12/2002 Kubota et al. ..... 345/100

FOREIGN PATENT DOCUMENTS

| | | |
|---|---|---|
| JP | 11-282426 | 10/1999 |
| JP | 2000242237 | 9/2000 |
| JP | 2001215928 | 8/2001 |

* cited by examiner

*Primary Examiner*—Richard Hjerpe
*Assistant Examiner*—Jean Lesperance
(74) *Attorney, Agent, or Firm*—Madson & Austin

(57) ABSTRACT

A method for generating sampling signals for use in an active matrix display is provided. Firstly, a plurality of pulse signals are sequentially generated, wherein every two adjacent pulse signals have a phase difference therebetween. Then, a guarding signal having alternate first level and second level is generated. Then, sampling signals associated with the pulse signals are outputted in response to the guarding signal being at the first level, and any sampling signal is exempted from outputting when the guarding signal is at the second level. A device for generating sampling signals for use in an active matrix display is also provided.

15 Claims, 4 Drawing Sheets

METHOD AND DEVICE FOR GENERATING SAMPLING SIGNAL

FIELD OF THE INVENTION

The present invention relates to a method and a device for generating sampling signals, and more particularly to a method and a device for generating sampling signals for use in an active matrix display.

BACKGROUND OF THE INVENTION

Liquid crystal displays (LCDs) are widely used in portable televisions, laptop personal computers, notebooks, electronic watches, calculators, mobile phones and office automation devices, etc. due to their advantages of small size, light weight, low driving voltage, low power consumption and good portability. A typical liquid crystal display comprises a driving circuit and an active matrix. The active matrix is generally implemented by a thin film transistor array, and driven by the driving circuit.

FIG. 1 is a schematic circuit diagram illustrating the configuration of a conventional driving circuit of a liquid crystal display. The driving circuit of FIG. 1 comprises a horizontal scanning circuit 10 for asserting a plurality of sampling pulses Φ1, Φ2, . . . to control respective switch elements 11, 12, . . . in either a turning-on or turning-off state. When one of the switch elements is turned on, an image signal SIG is transmitted to one of the data lines Y1, Y2, . . . , which is electrically connected to the turned-on switch element.

FIG. 2 is a timing waveform diagram showing the possible relation between the sampling pulses Φ1 and Φ2. Ideally, the sampling pulse Φ2 is asserted after the sampling pulse Φ1 changes to a low level. Since the horizontal scanning circuit may have some inherent adverse factors rendered by the manufacturing process, the generated sampling pulses are likely to partially overlap. As shown in FIG. 2, from t=t1 to t=t2, the switch element 11 is turned on, and the sampling pulse Φ1 is at a high level. At t=t1', which is slightly ahead of the turn-off time of the switch element 11, the switch element 12 is turned on. Therefore, the sampling pulses Φ1 and Φ2 overlap with each other from t1' to t2. The overlap between adjacent sampling pulses Φ1 and Φ2 indicates that the image signal SIG is simultaneously transmitted to two cells via both the data lines Y1 and Y2. The previous data may thus be wrongly displaced so as to distort the image for display.

SUMMARY OF THE INVENTION

It is an object of the present invention to provide a method and a device for generating non-overlapping sampling signals so as to assure of data accuracy.

In accordance with an aspect of the present invention, there is provided a method for generating sampling signals for use in an active matrix display. Firstly, a plurality of pulse signals are sequentially generated, wherein every two adjacent pulse signals have a phase difference therebetween. Then, a guarding signal having alternate first level and second level is generated. Then, sampling signals associated with the pulse signals are outputted in response to the guarding signal being at the first level, and any sampling signal is exempted from outputting when the guarding signal is at the second level.

In an embodiment, the plurality of pulse signals are generated in response to an enabling pulse signal and a pair of complementary clock signals.

In an embodiment, rising edges and falling edges of the pair of complementary clock signals are consistent with the guarding clock signal being at the second level.

In an embodiment, the sampling signals are produced according to a logic operation on each of the plurality of pulse signals with the guarding signal.

In an embodiment, the logic operation is a NAND operation, and the first and second levels of the guarding signal are high and low, respectively.

In an embodiment, method for generating sampling signals further comprises a step of adjusting levels of the sampling signals to control respective data switches for the active matrix display.

In accordance to another aspect of the present invention, there is provided a method for generating sampling signals for use in an active matrix display. Firstly, a plurality of pulse signals are sequentially generated in response to an enabling pulse signal and a pair of complementary clock signals. Then, a guarding signal is generated in response to the pair of complementary clock signals. Then, logic operations are performed on the guarding signal and the plurality of pulse signals to obtain respective logic values. Then, sampling signals are outputted according to the logic values.

In an embodiment, the guarding signal is logically low around rising edges and falling edges of the pair of complementary clock signals.

In an embodiment, the logic operations are NAND operations.

In an embodiment, the method for generating sampling signals further comprises a step of adjusting levels of the sampling signals to control respective data switches for the active matrix display.

In accordance to another aspect of the present invention, there is provided a device for generating sampling signals for use in an active matrix display. The device comprises a pulse signal generator, a guarding signal generator and a logic operation circuit. The pulse signal generator is used for sequentially generating a plurality of pulse signals. The guarding signal generator is used for generating a guarding signal. The logic operation circuit is electrically connected to the pulse signal generator and the guarding signal generator, receives the plurality of pulse signals and the guarding signal, and performs a logic operation on each of the plurality of pulse signals with the guarding signal to realize a logic state, and outputting a sampling signal only when the logic state is logically high.

In an embodiment, the pulse signal generator comprises a plurality of data shift registers.

In an embodiment, the plurality of pulse signals are generated in response to an enabling pulse signal and a pair of complementary clock signals.

In an embodiment, rising edges and falling edges of the pair of complementary clock signals are consistent with the guarding signal being logically low.

In an embodiment, the device for generating sampling signals further comprises a level adjusting circuit electrically connected to the logic operation circuit for adjusting a level of the sampling signal to control a corresponding data switch of the active matrix display.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
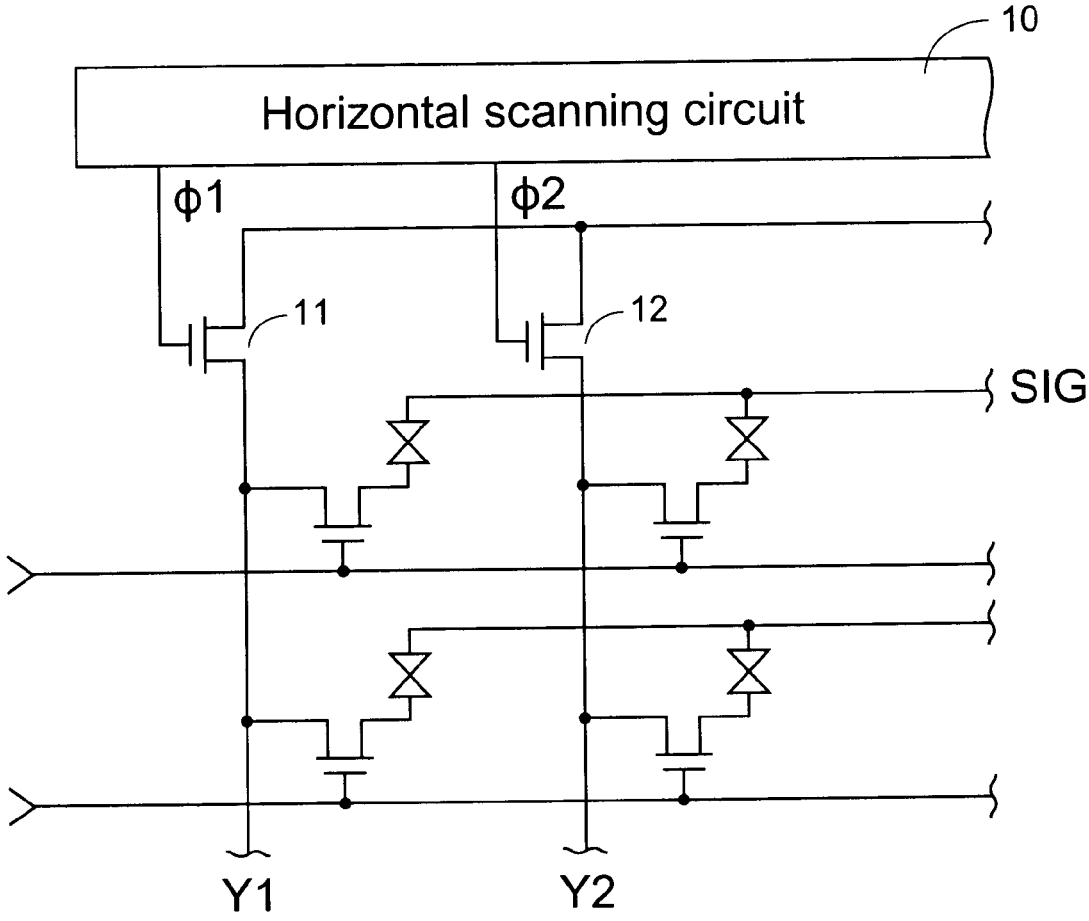
Fig.1 PRIOR ART
FIG. 1 is a schematic circuit diagram illustrating the configuration of a conventional driving circuit of a liquid crystal display.
Figure 2:
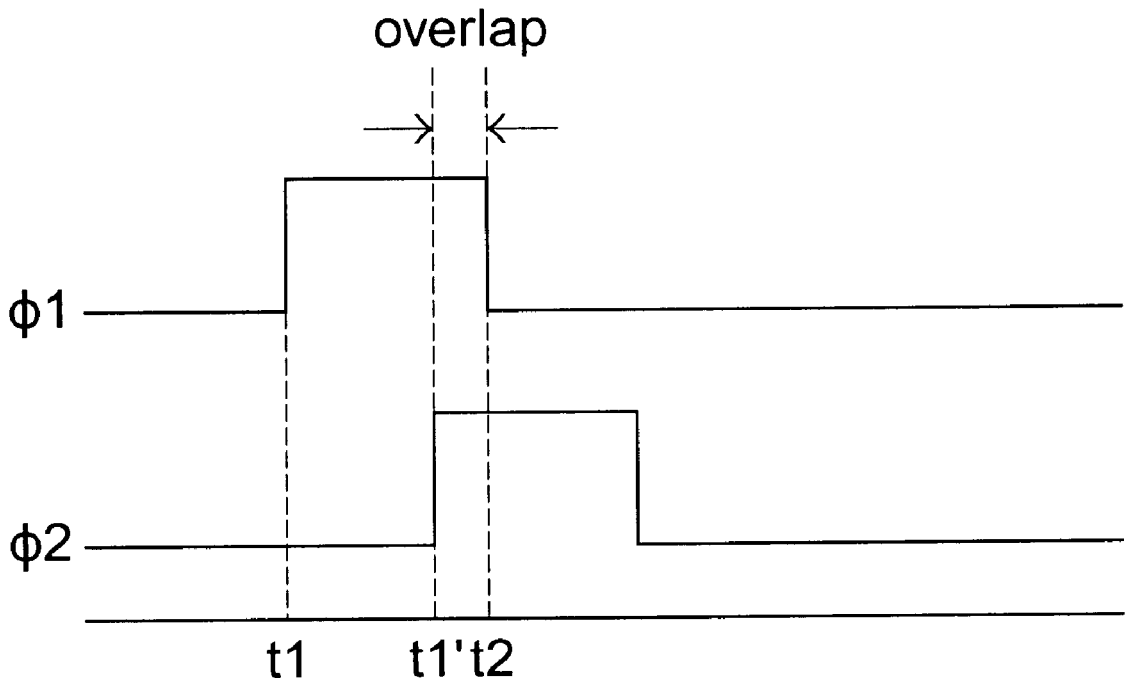
Fig.2 PRIOR ART
FIG. 2 is a timing waveform diagram showing the relation between two adjacent sampling pulses in the conventional driving circuit.
Figure 3:
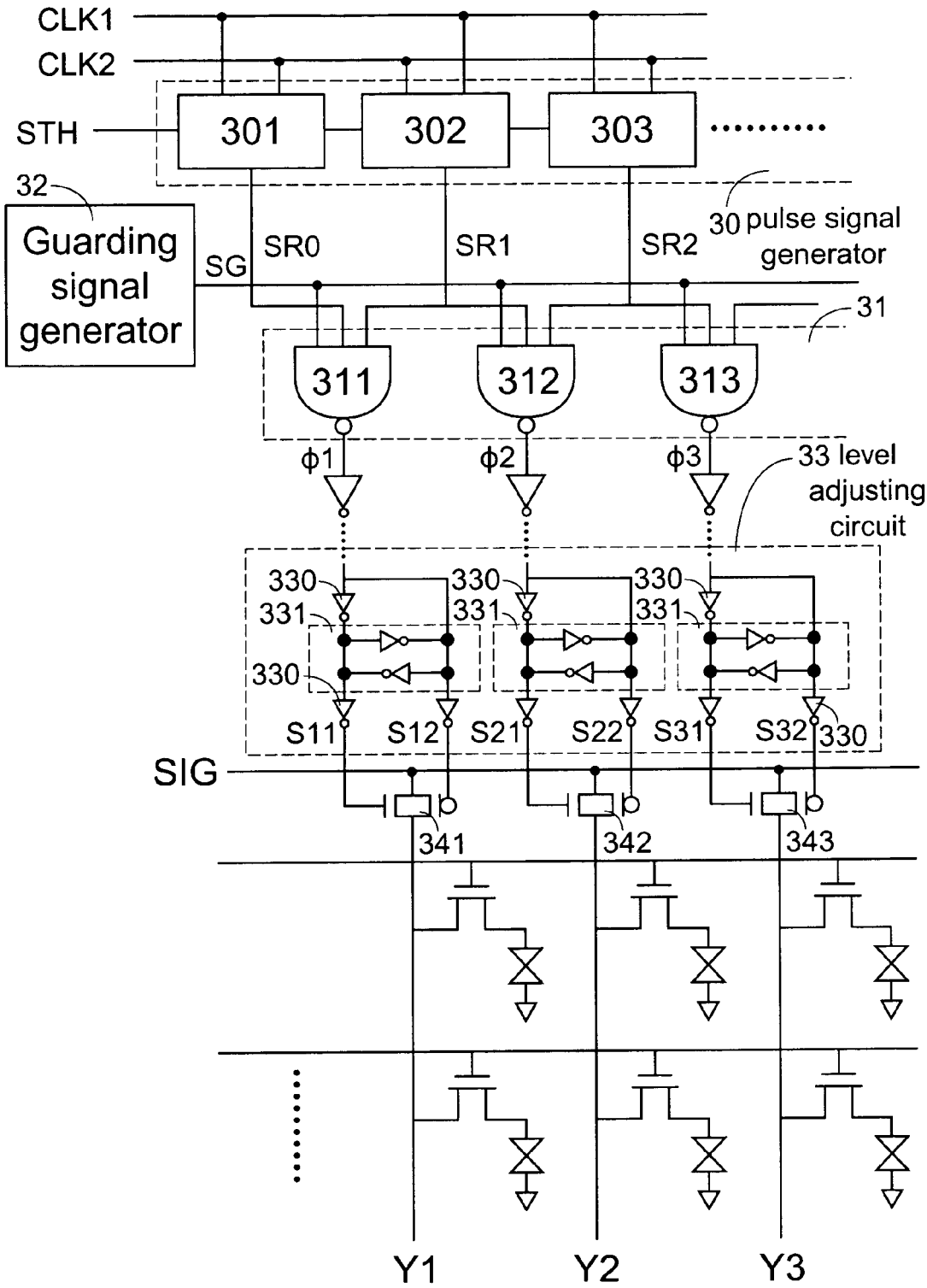
FIG. 3 is a schematic circuit diagram illustrating a device for generating sampling signals for use in an active matrix display according to a preferred embodiment of the present invention.

Please refer to FIG. 3, which illustrates a device for generating sampling signals for use in an active matrix display according to a preferred embodiment of the present invention. The device for generating sampling signals comprises a pulse signal generator 30, a logic operation circuit 31, a guarding signal generator 32 and a level adjusting circuit 33.

Figure 4A:
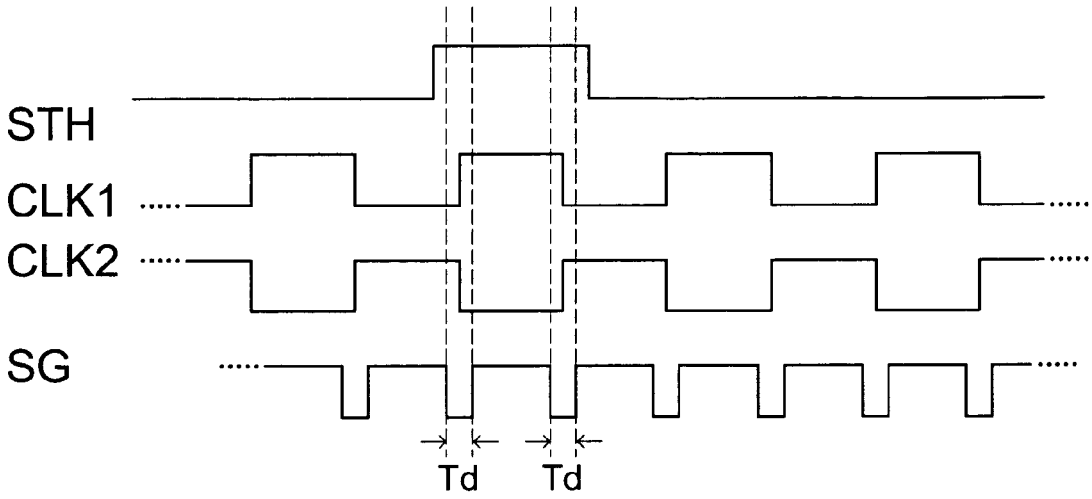
FIGS. 4(*a*), 4(*b*) and 4(*c*) are timing waveform diagrams illustrating concerned signals processed by the device of FIG. 3.
Figure 4B:
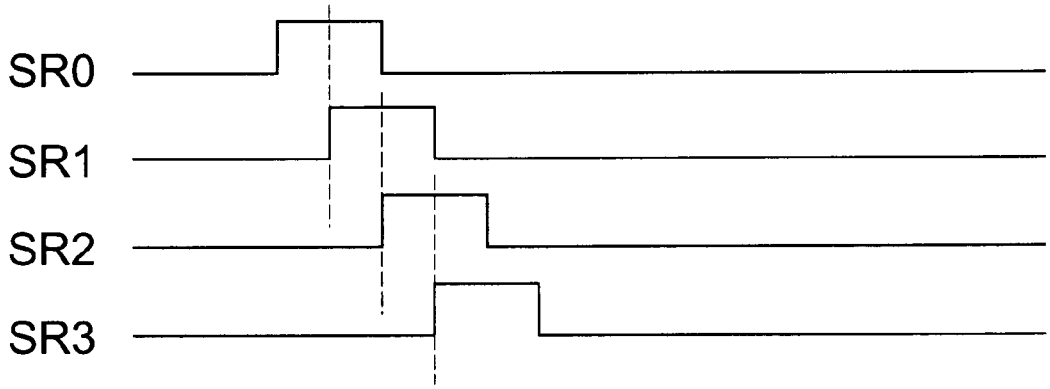
Figure 4C:
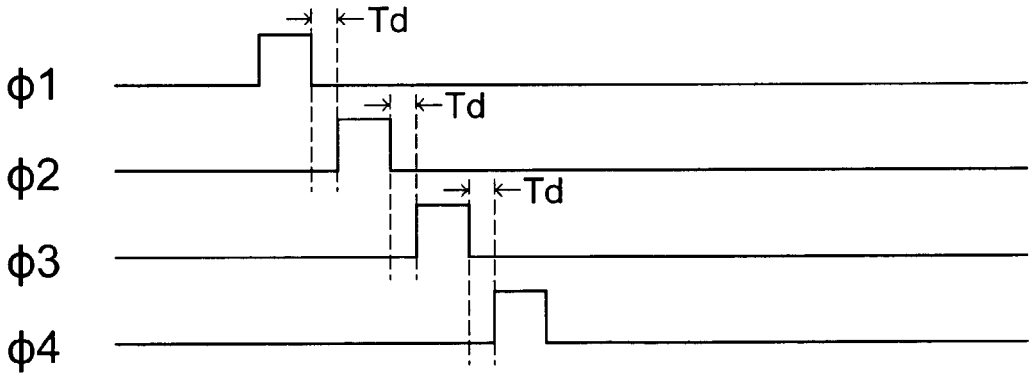

The pulse signal generator 30 comprises a plurality of data shift registers 301, 302, 303, . . . etc. A plurality of pulse signals SR0, SR1, SR2, . . . , are sequentially generated from these data shift registers in response to an enabling pulse signal STH and a pair of complementary clock signals CLK1 and CLK2. The guarding signal generator 32 is used to generate a guarding signal SG. FIG. 4(*a*) is timing waveform diagram showing relations between the enabling pulse signal STH, the pair of complementary clock signals CLK1, CLK2 and the guarding signal SG. The guarding signal SG has alternate high level and low level, wherein time span of the low level is Td. The rising edges and falling edges of the pair of complementary clock signals CLK1 and CLK2 are consistent with the guarding clock signal SG being at the low level. On the other hand, since at least one of the rising edges and falling edges of the pair of complementary clock signals CLK1 and CLK2 is covered by the enabling pulse signal STH being at the high level, every two adjacent pulse signals of the pulse signals SR0, SR1, SR2, . . . partially overlap with each other and have a phase difference therebetween, as can be seen in FIG. 4(*b*).

Please refer again to FIG. 3. The logic operation circuit 31 comprises a plurality of NAND gates 311, 312, 313, . . . , etc. The respective input ends of the NAND gates are electrically connected to the pulse signal generator 30 and the guarding signal generator 32. In each NAND gate, a NAND operation is performed on two adjacent pulse signals and the guarding signal SG to realize a logic state. Afterwards, a plurality of sampling signals Φ1, Φ2, . . . of the operated logic states are outputted from the NAND gates 311, 312, 313, . . . , respectively. In such way, these sampling signals will be non-overlapped. As can be seen in FIG. 4(*c*), every two adjacent sampling signals of the sampling signals Φ1, Φ2, . . . are separated by a time interval Td corresponding to the guarding signal SG at the low level.

The sampling signals Φ1, Φ2, . . . are processed by the level adjusting circuit 33 for the purpose of adjusting levels of the sampling signals in order to properly actuating data switches 341, 342, 343, . . . etc. The level adjusting circuit 33 comprises a plurality of inverters 330 and functions as a buffer. For example, the inverters 330 communicated with the NAND gates 311 process the sampling signals Φ1 into a pair of complementary switching pulse signals S11 and S12. Likewise, the inverters 330 communicated with the NAND gates 312 processes the sampling signals Φ2 into a pair of complementary switching pulse signals S21 and S22. The complementary switching pulse signals will be transmitted to control respective data switches 341, 342, 343, . . . of the active matrix display in either a turning-on or turning-off state. Each of the data switches is implemented by a transmission gate. Preferably, the level adjusting circuit 33 further comprises a plurality of ring inverters 331 in order to synchronize the output of each pair of complementary switching pulse signals. When one of the data switches is turned on, e.g. the data switch 341, an image signal SIG is transmitted to a corresponding one of the data lines Y1, Y2, . . . , e.g. the data line Y1.

It is understood that the data accuracy could be effectively increased by using the present device for generating sampling signals without overlapping with each other. Thus, non-distorted images will be outputted for display so as to increase image quality of liquid crystal display.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A method for generating sampling signals for use in an active matrix display, said method comprising steps of:

sequentially generating a plurality of pulse signals, every two adjacent pulse signals having a phase difference therebetween;

generating a guarding signal having alternate first level and second level; and outputting sampling signals associated with said pulse signals in response to said guarding signal being at said first level, and exempting from outputting any sampling signal when said guarding signal is at said second level.

2. The method according to claim 1 wherein said plurality of pulse signals are generated in response to an enabling pulse signal and a pair of complementary clock signals.

3. The method according to claim 2 wherein rising edges and falling edges of said pair of complementary clock signals are consistent with said guarding clock signal being at said second level.

4. The method according to claim 1 wherein said sampling signals are produced according to a logic operation on each of said plurality of pulse signals with said guarding signal.

5. The method according to claim 4 wherein said logic operation is a NAND operation, and said first and second levels of said guarding signal are high and low, respectively.

6. The method according to claim 1 further comprising a step of adjusting levels of said sampling signals to control respective data switches for said active matrix display.

7. A method for generating sampling signals for use in an active matrix display, said method comprising steps of:

sequentially generating a plurality of pulse signals in response to an enabling pulse signal and a pair of complementary clock signals;

generating a guarding signal in response to said pair of complementary clock signals;

performing logic operations on said guarding signal and said plurality of pulse signals to obtain respective logic values; and outputting sampling signals according to said logic values.

8. The method according to claim 7 wherein said guarding signal is logically low around rising edges and falling edges of said pair of complementary clock signals.

9. The method according to claim 8 wherein said logic operations are NAND operations.

10. The method according to claim 7 further comprising a step of adjusting levels of said sampling signals to control respective data switches for said active matrix display.

11. A device for generating sampling signals for use in an active matrix display, said device comprising:

a pulse signal generator for sequentially generating a plurality of pulse signals;

a guarding signal generator for generating a guarding signal; and a logic operation circuit electrically connected to said pulse signal generator and said guarding signal generator, receiving said plurality of pulse signals and said guarding signal, and performing a logic operation on each of said plurality of pulse signals with said guarding signal to realize a logic state, and outputting a sampling signal only when said logic state is logically high.

12. The device according to claim 11 wherein said pulse signal generator comprises a plurality of data shift registers.

13. The device according to claim 12 wherein said plurality of pulse signals are generated in response to an enabling pulse signal and a pair of complementary clock signals.

14. The device according to claim 13 wherein rising edges and falling edges of said pair of complementary clock signals are consistent with said guarding signal being logically low.

15. The device according to claim 11 further comprising a level adjusting circuit electrically connected to said logic operation circuit for adjusting a level of said sampling signal to control a corresponding data switch of said active matrix display.

* * * * *